US006101967A

United States Patent [19]

Glass et al.

[11] Patent Number: 6,101,967

[45] Date of Patent: Aug. 15, 2000

[54] PLASTIC BARRICADE ASSEMBLY

[75] Inventors: Geoffrey M. Glass, Rolling Meadows, Ill.; Wayne J. Brocka, Readlyn; Douglas C. Madsen, Waverly, both of Iowa

[73] Assignee: Plasticade Products Corporation, Rolling Meadows, Ill.

[21] Appl. No.: 09/005,119

[22] Filed: Jan. 9, 1998

[51] Int. Cl.[7] ..... E01F 9/012

[52] U.S. Cl. ..... 116/63 P; 404/9; 40/610

[58] Field of Search ..... 116/63 R, 63 P; 404/6, 9; 256/13.1, 64; 40/606, 610

[56] References Cited

U.S. PATENT DOCUMENTS

| | | | |
|---|---|---|---|
| 3,880,406 | 4/1975 | Stehle et al. | 256/64 |
| 3,971,331 | 7/1976 | Sawyer | 116/63 P |
| 4,624,210 | 11/1986 | Glass . | |
| 5,003,912 | 4/1991 | Thurston | 116/63 P |
| 5,184,697 | 2/1993 | Crewe et al. | 182/153 |
| 5,458,434 | 10/1995 | Bent et al. | 404/6 |
| 5,544,614 | 8/1996 | Cushman | 116/63 P |
| 5,762,444 | 6/1998 | Giannelli | 404/9 |
| 5,794,923 | 8/1998 | Bartlett | 256/64 |

OTHER PUBLICATIONS

TrafFix Devices Inc. brochure, TrafFix Plastic Folding Barricade (4 pages) (1996).

Universal brochure, Universal Plastic Barricade (2 pages) (1996).

*Primary Examiner*—Andrew H. Hirshfeld
*Assistant Examiner*—R. Alexander Smith
*Attorney, Agent, or Firm*—Richard G. Lione; Brinks Hofer Gilson & Lione

[57] ABSTRACT

A plastic barricade assembly including two leg and panel units pivotally interconnected. Each leg and panel unit comprises first and second leg members and a plurality of panel members, the members being separately blow molded. The first leg members of each leg and panel unit are identical to each other and, at the same time, different than the second leg members of each leg and panel unit which are, in turn, identical to each other. Each leg and panel unit is assembled by bolting a first and second leg member together with a plurality of panel members. The leg and panel members of each unit are bolted together in interlocking relationship.

8 Claims, 7 Drawing Sheets

PLASTIC BARRICADE ASSEMBLY

FIELD OF THE INVENTION

This invention relates to traffic barricades. It relates particularly to molded plastic traffic barricades.

BACKGROUND OF THE INVENTION

Traffic barricades are commonly used to warn vehicular and pedestrian traffic of danger, and block off restricted areas. Barricades made of molded plastic have now been known for some time. Examples are found in the Stehle, et al. U.S. Pat. Nos. 3,880,406 and 3,950,873, the Glass U.S. Pat. Nos. 4,298,186 and 4,624,210. Barricades illustrated in these patents include barricades made with two panel units hinged together so that they can be spread apart for use and collapsed for storage or transport. The individual panel units are one piece, integral, hollow plastic panels, formed by rotational or blow molding. The lower hollow sections may contain ballast.

These and other plastic traffic barricades have proven to be a great improvement over conventional steel and wood barricades. They are rugged, yet cause less damage to vehicles if inadvertently struck. Through the use of ballast in the units, the center of gravity of the barricade is lower than either wood or metal barricades. The result is a barricade less susceptible to being blown over by wind. Other features typically incorporated in such barricades are bright colored reflective horizontal panels, flashing lights or signs, and a structural member near the bottom where a sand bag can be placed if additional ballast is required.

Problems linger with many plastic barricades on the market today, however. Internally ballasted plastic barricades have proven to be marginally acceptable on high speed highways because they are not heavy enough to remain in place when buffeted by vehicle induced drafts. All to frequently, on the other hand, externally ballasted barricades deform under the weight of sandbags. When barricade assemblies are struck by a moving vehicle, for example, their structural integrity also leaves something to be desired. When components are damaged, they cannot be readily cannibalized for use in other barricade assemblies. Many of them are not sufficiently compact to permit stacking large quantities of assembled barricades together for transport.

SUMMARY OF THE INVENTION

A primary object of the present invention is to provide an improved plastic barricade assembly.

Another object is to provide a plastic traffic barricade assembly which has a high degree of structural integrity.

Yet another object is to provide a plastic traffic barricade assembly which can be easily cannibalized for parts if it is damaged in use.

Still another object is to provide a plastic traffic barricade assembly which, although employing ruggedly substantial leg components, collapses into a narrow profile for storage and shipping.

A further object is to provide a plastic traffic barricade assembly comprising separately blow molded leg and panel members fastened together in interlocking relationship.

Yet a further object is to provide a plastic traffic barricade assembly wherein said separately molded leg and panel members are rigidly interconnected after molding to form two substantially identical leg and panel units which are then pivotally connected.

Still a further object is to provide a new and improved method of constructing a plastic traffic barricade assembly.

The foregoing and other objects are realized in accord with the present invention by providing a barricade assembly comprising separate leg and panel members blow-molded of high molecular weight polyethylene plastic. Two identical leg and panel units are assembled, each from first and second different leg members and a plurality of panel members. The first leg members of each unit are identical to each other. The second leg members of each unit are, in turn, identical to each other.

The leg members are all molded with body sections which have I-beam shaped cross-sections, including opposed flanges interconnected by a web. This configuration permits the leg members to be quite narrow, i.e., the flanges are one-and-one-half (1½") inch wide in a conventional size barricade.

The outer flanges on each leg member in a leg and panel unit have elongated depressions formed therein, each for receipt of a panel. Each panel, in turn, has a corresponding one-and-one-half inch (1½") wide channel formed in its back face for mating, in interlocking fashion, with a leg member depression. The panel members are bolted to each of first and second leg members in this relationship to form a leg and panel unit.

Two leg and panel units are then mated with each other, panel members facing outwardly, by interconnecting bearing elements and bearing bores molded unitarily into the head sections of first and second leg members, respectively. The bearing element and bore of corresponding pairs of head sections contain cam action limit stops which then limit spreading of the leg and panel units to a degree desirable for use. The head section of each of the first leg elements also has an ear formed in it which is adapted to engage the upper edge of a panel member on the opposite leg and panel unit to provide a second limit stop for unit opening.

The leg and panel units are bolted together on common axes which are offset from the centerlines of corresponding leg members by a distance corresponding to the panel members' thickness. This permits the leg and panel units to nest flat against each other when the barricade assembly is collapsed for storage or use.

DESCRIPTION OF THE PREFERRED EMBODIMENT

Figure 2:
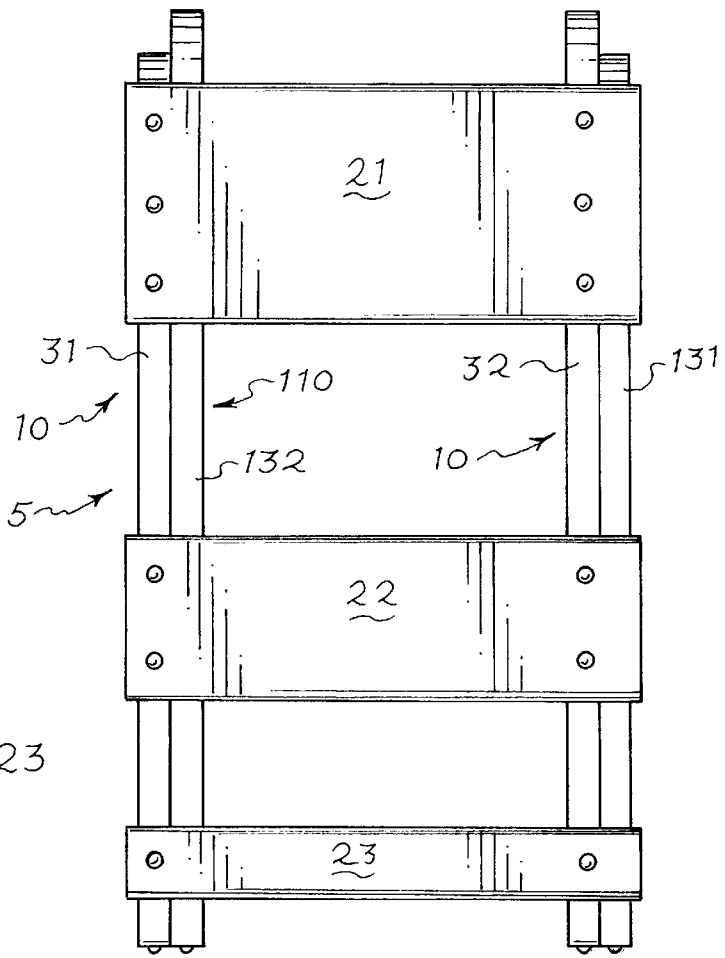
FIG. 2 is a front elevational view of the barricade assembly.
Figure 1:
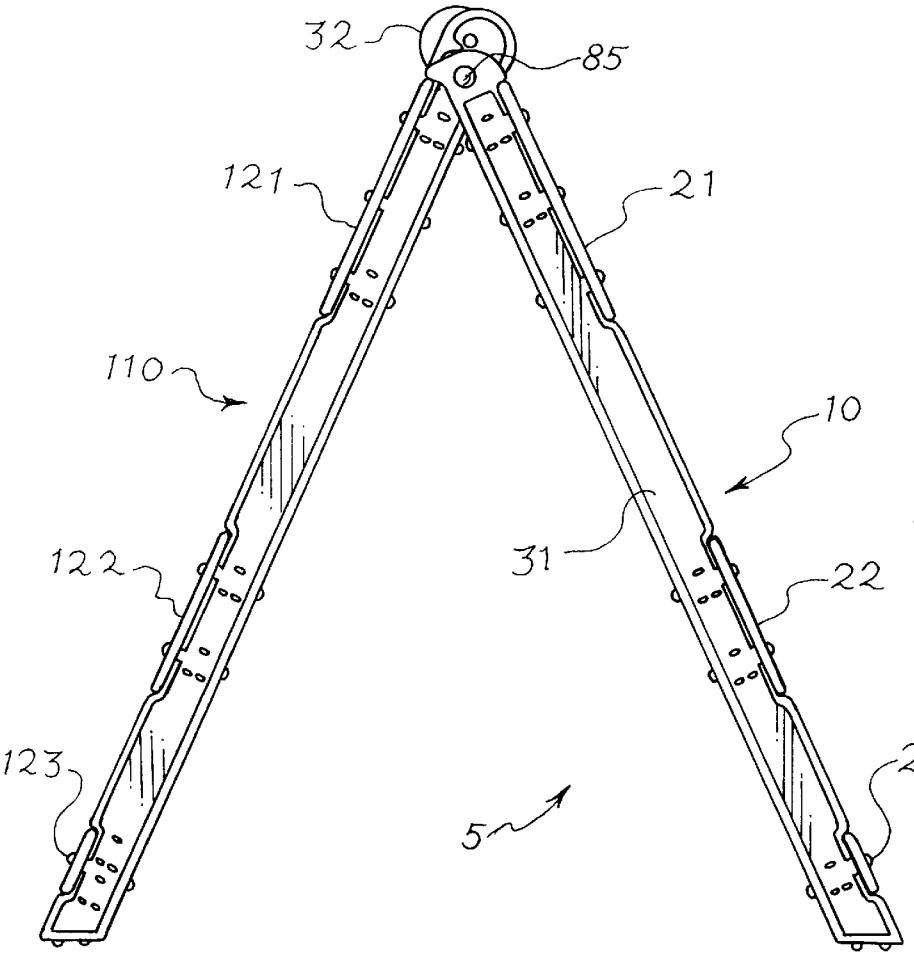
FIG. 1 is a side elevational view of a barricade assembly embodying features of the present invention.

Referring to the drawings, and particularly to FIGS. 1 and 2, a plastic barricade assembly embodying features of the present invention is seen generally at 5. The assembly 5 is comprised of a pair of identical leg and panel units 10 and 110. Only leg and panel unit 10 will be described in detail, it being understood that the leg and panel unit 110 is identical to it. Throughout the specification, all parts of the leg and panel unit 110 are numbered exactly as their counterparts in leg and panel unit 10, with an added 100 digits.

Each leg and panel unit 10 comprises three horizontal panel members 21, 22 and 23, and two vertical leg members 31 and 32. Each of the members 21, 22 and 23, and 31 and 32 is separately blow molded of a high molecular weight polyethylene plastic. The members 21, 22 and 23, and 31 and 32, and corresponding members 121, 122 and 123, and 131 and 132, are assembled in a manner hereinafter discussed to create the assembly 5.

Figure 4:
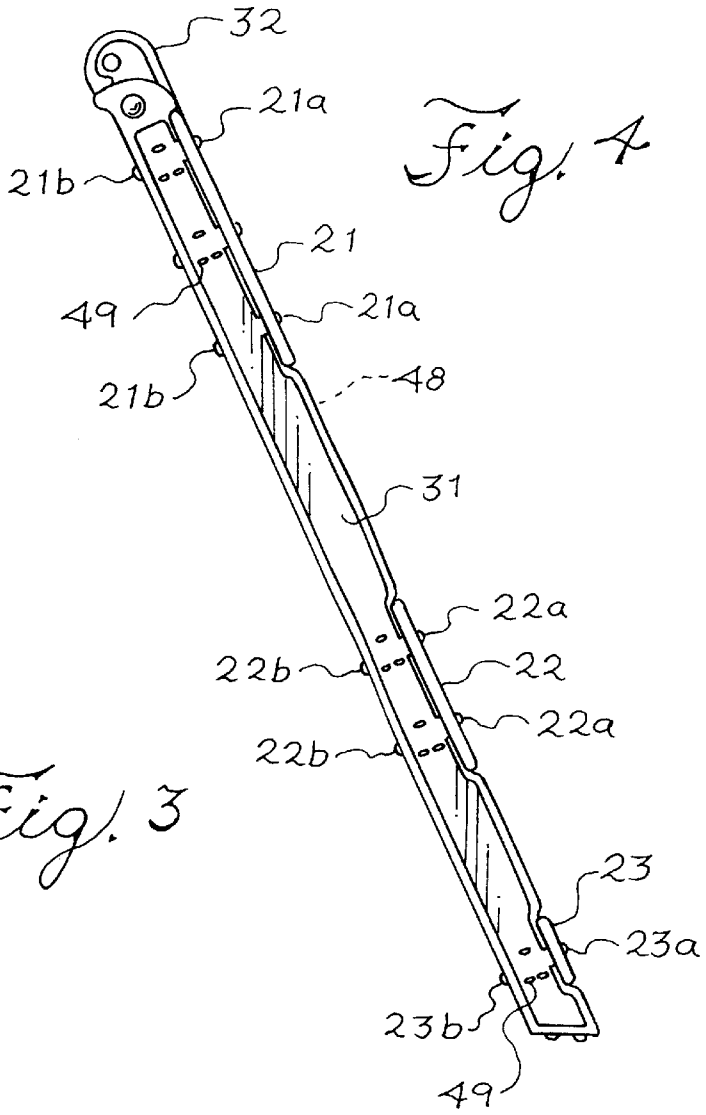
FIG. 4 is a side elevational view of the leg and panel unit of FIG. 3.
Figure 3:
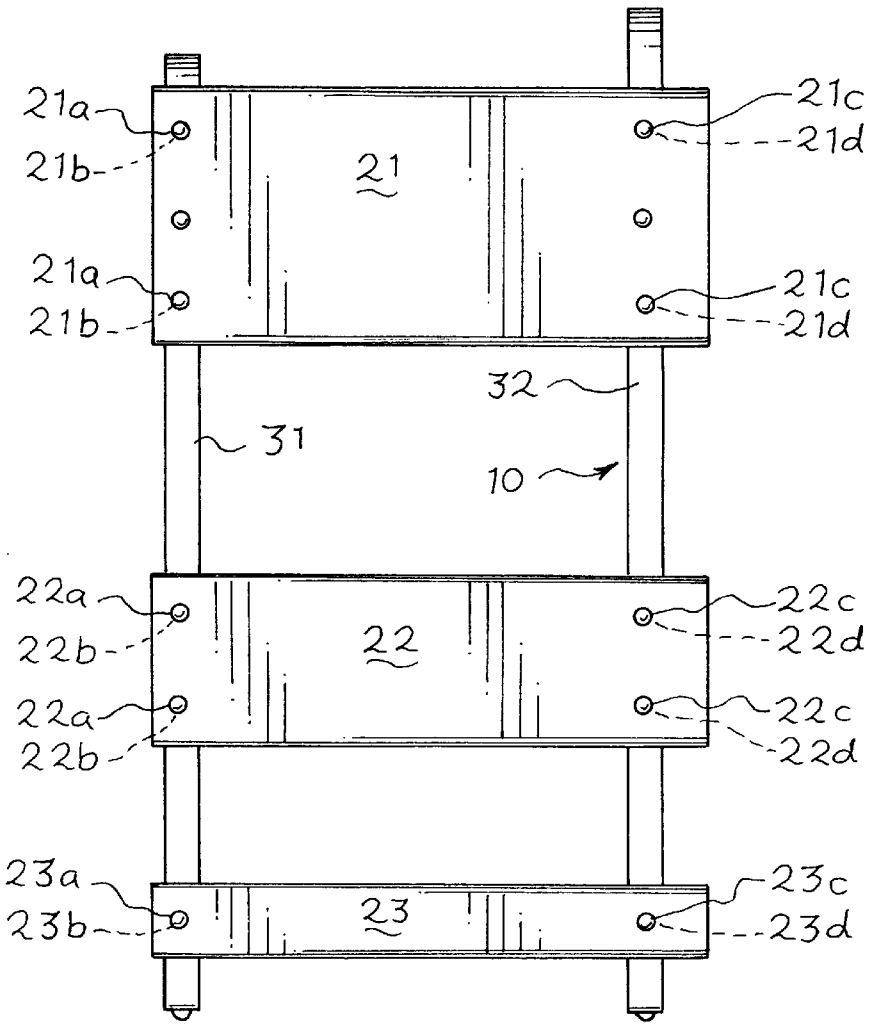
FIG. 3 is a front elevational view of one leg and panel unit for the barricade assembly.

Referring now to FIGS. 3 and 4, a separate leg and panel unit 10 is shown. The panel members 21, 22, and 23, and the leg members 31 and 32 of the leg and panel unit 10 are rigidly interconnected, according to the invention, to assemble the unit 10.

As will be seen, the panel members 21, 22 and 23 are mounted on, and interconnected with, the leg members 31 and 32. The leg members 31 and 32 are spaced approximately twenty inches (20") apart in a standard size barricade.

The panel member 21 is fastened, adjacent one of its ends, to the leg member 31 by bolts 21*a* and nuts 21*b*. Similarly, the panel member 22 is fastened to the leg member 31 adjacent one end of the panel member by bolts 22*a* and nuts 22*b*. Likewise, the panel member 23 is fastened to the leg member 31 adjacent one end of this panel member by bolts 23*a* and nuts 23*b*.

The panel member 21 is, in turn, fastened to the leg member 32 by bolts 21*c* and nuts 21*d*. In turn, the panel member 22 is fastened to the leg member 32 by bolts 22*c* and nuts 22*d*. Finally, the panel member 23 is fastened to the leg member 32 by bolts 23*c* and nuts 23*d*. In contrast to their attachments to the leg member 31, however, the panels members 21, 22 and 23 are fastened to the leg member 32 at a greater distance from the opposite ends of corresponding panel members, as will be seen. This distance is greater by an amount corresponding to the width of a leg member 31 or 32, as seen in FIG. 3; and one-and-one inch (1½") in a barricade of standard size. Thus, the panel members 21, 22 and 23 are mounted in laterally offset relationship relative to the leg members 31 and 32. As a result, when the panel units 10 and 110 are assembled in face to face relationship, in a manner hereinafter discussed, the panel members 21, 22 and 23 on opposed panel units have their opposite ends aligned with each other, as seen in FIG. 2.

The bolts 21*a* and 21*c*, 22*a* and 23*a* and 23*c* extend from their low-profile heads (seen in FIG. 3), which engage the panels 21, 22 and 23, respectively, through suitably formed aperatures in the panels and corresponding legs 31 or 32, in a manner hereinafter discussed in detail. The free ends of the bolts are threaded and receive corresponding nuts, 21*b* and 21*d*, 22*b* and 22*d*, and 23*b* and 23*d*.

Referring now to FIGS. 5–8, a disassembled leg member 31 is illustrated. The leg member 31, which is blow molded in one piece, includes an elongated center section 41, a foot section 42 and a head section 43. As is characteristic of blow molding, of course, the leg member 31 is essentially hollow, with a wall thickness of approximately 0.125 inches.

Figure 8:
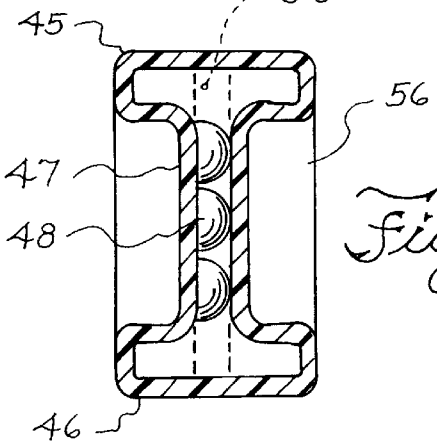
FIG. 8 is a sectional view taken along line 8—8 of FIG. 5.

The central section 41 is molded with an I-beam cross-section, as best seen in FIG. 8. The I-beam cross-section is defined by outer flange 45 and inner flange 46 connected by web 47. The wall which forms the leg member 31, in its central section 41, is spaced apart along most of the central section. However, in the blow molding process, a plurality of inwardly extending offsets or "tacks" 48 and 49 are formed in the web 47, from one side thereof and those tacks become welded to the other side of the web during the molding process. The tacks 48 help to rigidify the central section 41. The tacks 49 bracket bolt holes, hereinafter discussed, to strengthen the central section 41 at these bolt holes.

The outer flange 45 of the central section 41 is also molded with inwardly extending offsets in three areas to form three elongated depressions 51, 52 and 53 in its outer surface. The lengths of each of these depressions corresponds to the height of a corresponding panel member 21, 22 and 23, a subject hereinafter discussed. The depth of each of these depressions 51, 52 and 53 is one-half the thickness of each panel member, but each depression has at least one deeper cut-out (see 51 a in FIG. 5, for example), for reasons hereinafter discussed. According to the invention, this configuration permits a highly effective, interlocking relationship of panel members 21, 22 and 23 and leg member 31 when a panel unit 10 is assembled.

The central section 41 of the leg member 31 also has the aforementioned bolt holes 55 formed vertically through it, from flange 45 to flange 46, inside the web 47. Bolt holes 55 are formed through the leg member 31 in each of the three depressions 51, 52 and 53. As will hereinafter be discussed, the panel numbers 21, 22 and 23 are fastened to the leg member 31 with corresponding bolts which extend through these bolt holes 55.

The foot section 42 of the leg member 31 is defined by a thickened end flange 56 formed in the molding process. The flange 56 defines a ground engaging surface for the leg member 31.

The head section 43 of the leg member 31 includes a radially extending ear 58. As will also hereinafter be discussed, the ear 58 is arranged to engage the upper edge of the panel member 121 when the barricade assembly 5 is opened for operation and serve as a limit stop for opening travel of the two panel sections 10 and 110 as they are spread for use.

Figure 7:
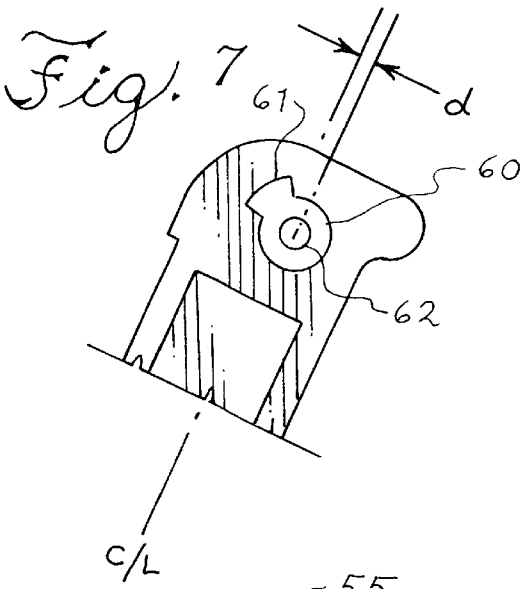
FIG. 7 is an enlarged side view (from the back) of the head section in the leg member seen in FIG. 6.
Figure 6:
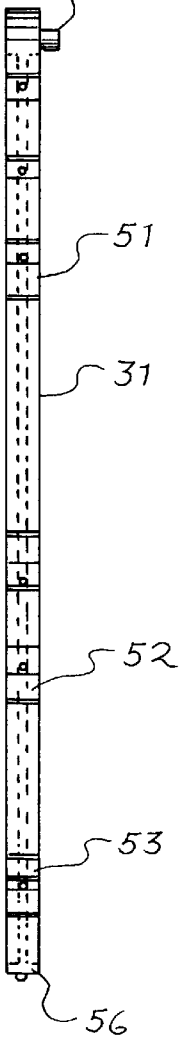
FIG. 6 is a front elevational view of the first leg member seen in FIG. 5.
Figure 5:
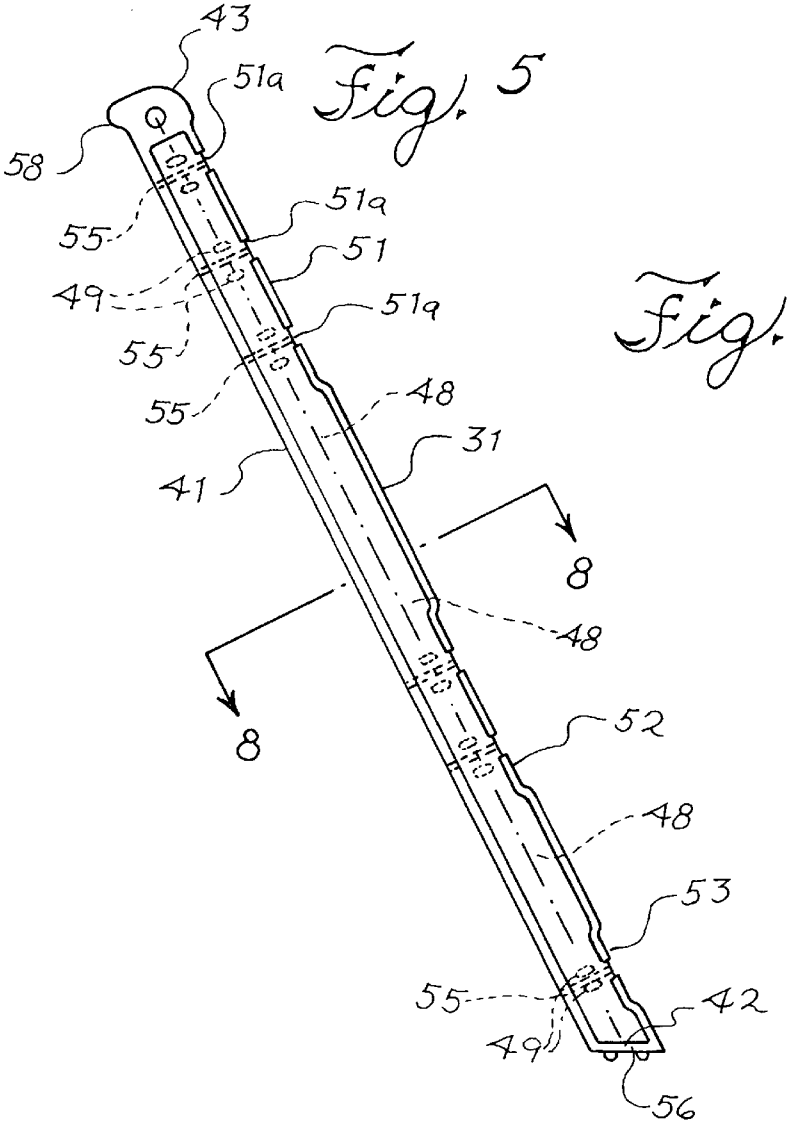
FIG. 5 is a side elevational view of a first leg member for the leg and panel unit of FIG. 3.

Referring to FIGS. 6 and 7, the head section 43 also has an annular stub bearing 60 formed outwardly from one side. The axis of the stub bearing 60, which serves as a pivot axle for the panel units 10 and 110 when they are connected, is spaced from the centerline C/L of the leg member 31 by a distance d corresponding to the thickness of each of the panel members 21, 22 and 23; the centerline of a panel unit being defined here as a line extending longitudinally of the leg member half-way between the flanges 45 and 46. This offset, which is toward the inside of the leg member 31, permits the panel units 10 and 110 to nest flat against each other when they are collapsed, also in a manner hereinafter discussed.

The annular stub bearing 60 has a radially protruding cam 61 formed unitarily with it. This cam 61 acts as another limit stop for opening travel of the two panel sections, in a manner hereinafter discussed.

The annular stub bearing 60 has a bolt hole 62 formed through it on its axis. This bolt hole 62 also extends through the wall of the head section 32 opposite the bearing 60. The function of this bolt hole 62 in the barricade assembly 5 will be hereinafter discussed.

Figure 9:
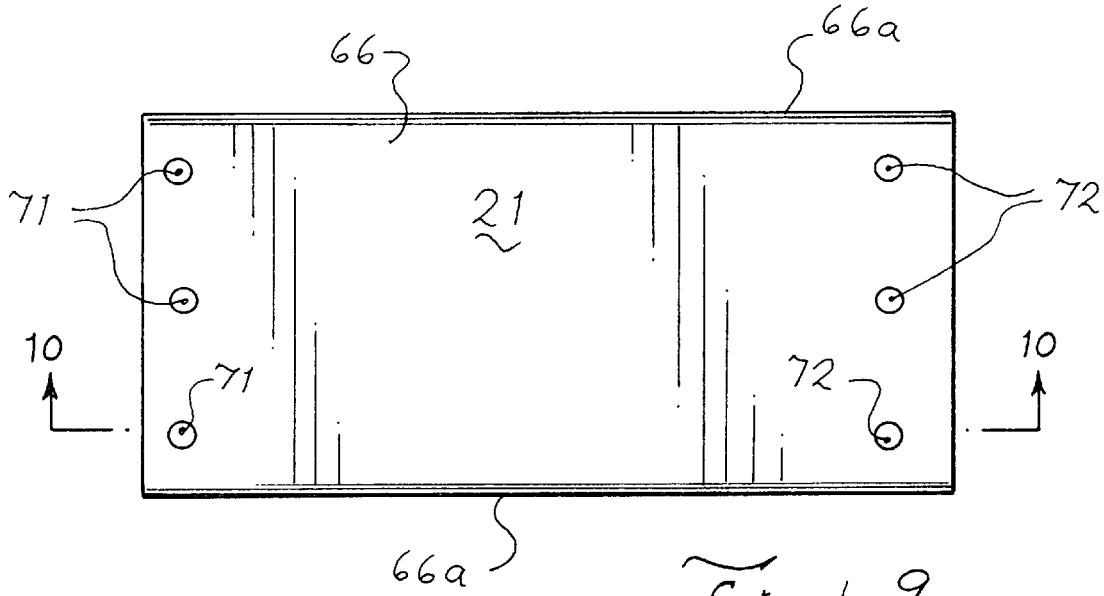
FIG. 9 is a front plan view of a panel member from the leg and panel unit of FIG. 3.
Figure 10:
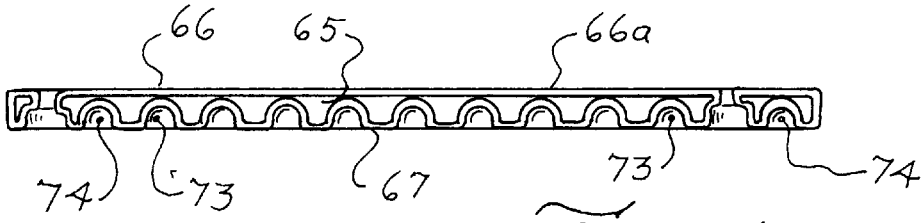
FIG. 10 is an edge elevational view of the panel member seen in FIG. 9.
Figure 11:
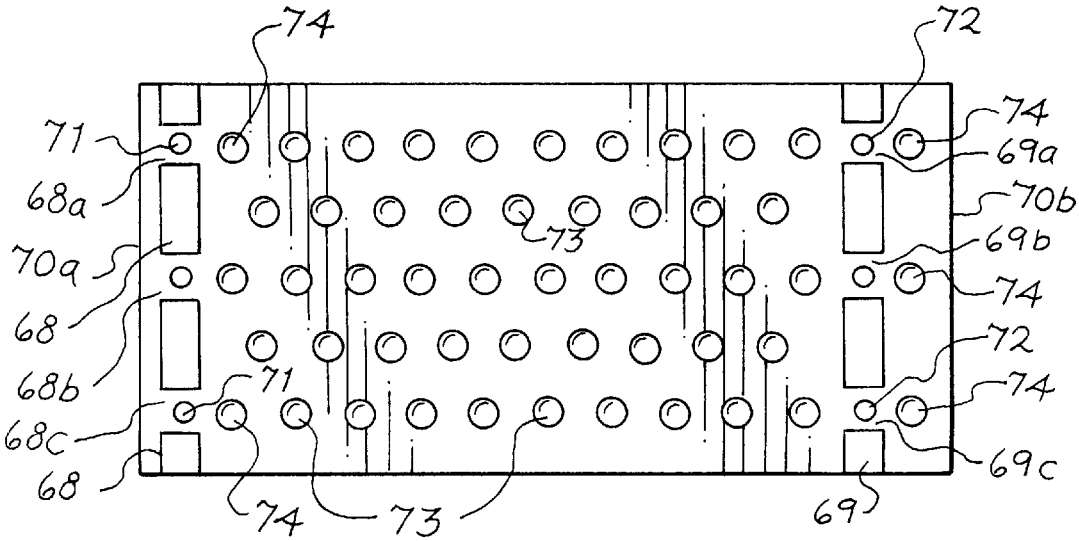
FIG. 11 is a bottom plan view of the panel member seen in FIG. 9.

Referring now to FIGS. 9–11, a separate panel member 21 is illustrated. The panel member 21 is blow molded of plastic so that its walls are also about 0.125 inch thick. The panel, itself, is one-half inch (½") thick. As such, a cavity 65 is defined within the panel member 21.

The outer wall 66 of the panel member 21 has an essentially smooth outer surface, although outwardly extending ridges 66*a* are formed horizontally along its upper and lower edges. This facilitates the surface-to-surface fastening of reflective sheeting, for example, between the ridges 66*a*.

The inner wall 67 of the panel 21 has two discontinuous mounting channels 68 and 69 molded into its outer surface. One of these channels, channel 68, is formed into the wall 67 three-quarters of an inch (¾") from an end 70*a* of the panel 21. This channel 68 is one-quarter inch (¼") deep and one and one-half inch (1½") wide, except where it is discontinuous, at 68*a*, 68*b* and 68*c*, the discontinuities creating air passages through the channel 68 for molding purposes. The other channel, channel 69, is formed into the wall 67 one-and-three quarters of an inch (1¾") from the other end 70*b* of the panel 21. This channel 69 is also one-quarter inch (¼") deep and one inch (1") wide, except where it is discontinuous, at 69*a*, 69*b* and 69*c*, the discontinuities creating internal air passages for blow-molding purposes.

The panel member 21 also has two bolt holes 71 formed through it in the channel 68. These bolt holes 71 are for the bolts 21 a which attach the panel member 21 to the leg member 31. Two more bolt holes 72 are formed through the panel member 21 in the channel 69. These bolt holes 72 are for the bolts 21*c*.

In the inner wall 67 of the panel member 21, a pattern of cup-shaped indentations 73 are formed inwardly from the outer surface of that wall. These indentations 73 extend into engagement with the inner surface of the outer wall 66 of the panel member 21, and form "tacks" between the walls 66 and 67 by bonding during molding. Four of the cup-shaped indentations, seen at 74, serve an additional purpose, as will hereinafter be discussed.

Panel members 22 and 23 are identical in construction to panel member 21, except for their width dimensions and number of bolt holes. The panel member 21 is twenty four inches (24") long and twelve inches (12") wide. The panel member 22 is eight and one quarter inches (8¼") wide. The panel member 23 is three inches (3") wide.

Figure 14:
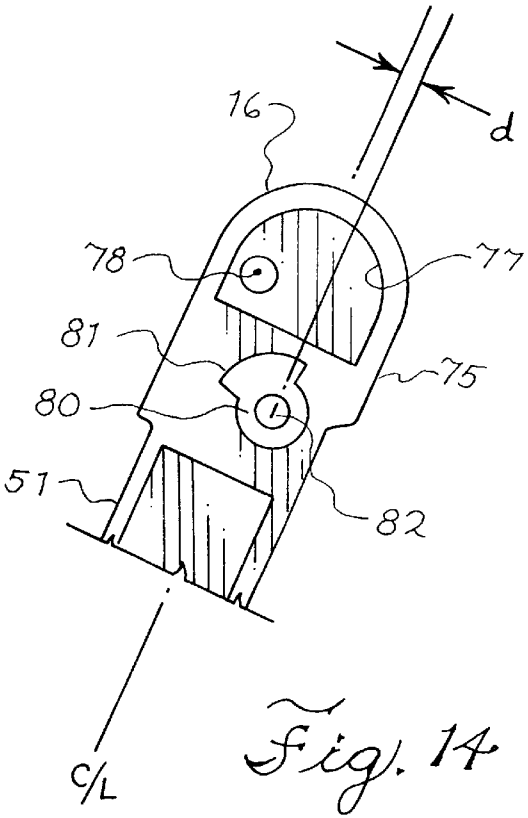
FIG. 14 is an enlarged side view (from the back) of the head section in the leg member seen in FIG. 13.
Figure 13:
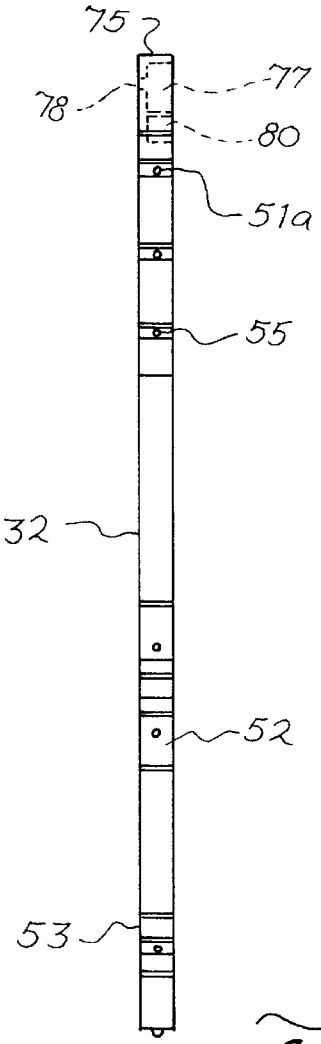
FIG. 13 is a front elevational view of the second leg member seen in FIG. 12.
Figure 12:
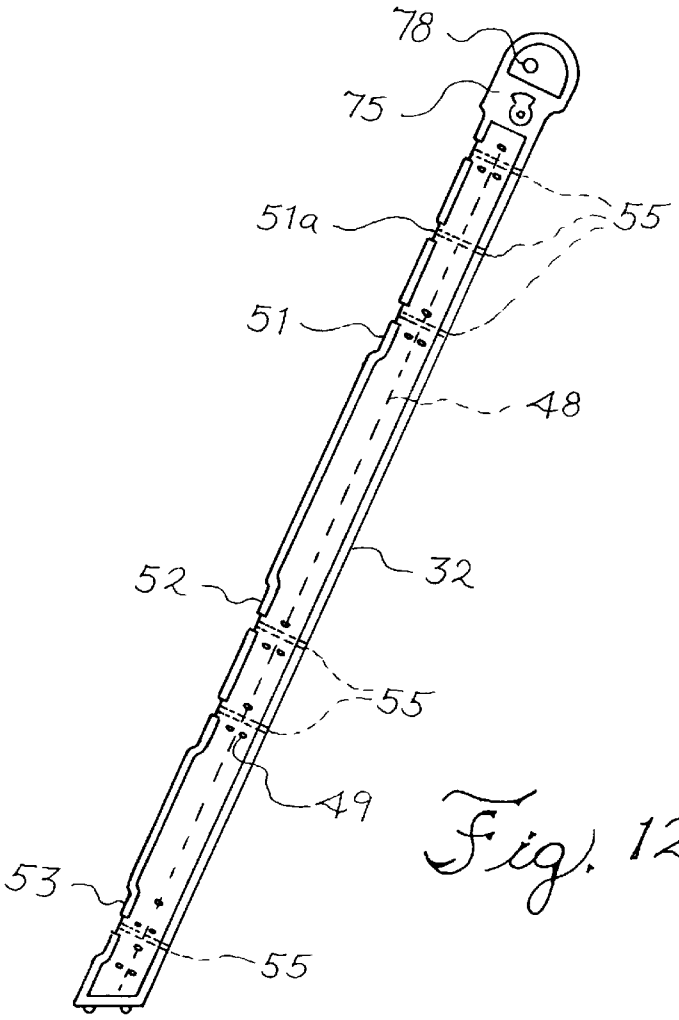
FIG. 12 is a side elevational view of the second leg member for the leg and panel unit of FIG. 3.

Turning now to FIGS. 12–14, the leg member 32 is also seen separately. FIG. 12 illustrates the leg member 32 as it would be seen from the right in FIG. 2. FIG. 13 shows the same leg members 32 from the front. FIG. 14 is an enlarged view of the head section 75 of the leg member 32.

As has previously been pointed out, the leg member 32 is identical to the leg member 31, except for the construction of the head section 75. Accordingly, except for the head section 75, all components of the leg member 32 bear the same reference numerals as the leg member 31.

The head section 75 of the leg member 32 includes an elongated crown 76 which forms a bracket for attachment of a flasher warning light unit (not shown). To this end, it will be seen that the crown 76 has a well 77 formed in one side for receipt of a light unit mounting base and attachment bolt (not shown). A bolt hole 78 is formed through the crown 76 in the well 77 for receipt of a bolt (not shown) which attaches the light unit.

Referring to FIG. 14, the head section 75 also has an annular bearing bore 80 formed inwardly from one side. The bearing bore 80, which serves as a pivot axle bearing for the panel units 10 and 110 when they are connected has, like the stub bearing 60 on the leg member 31, an axis which is offset from the centerline C/L of the leg member 32 by the distance d hereinbefore referred to, and for the same purpose.

The annular bearing bore 80 has a radially extending lobe 81 covering an arcuate distance corresponding generally to the travel which the aforedescribed cam 61 is permitted when the panels 10 and 110 are spread to operational relationship. The mating of the stub bearing 60 and bore 80, cam 61 and bore lobe 81, will hereinafter be further discussed.

The annular bearing bore 80 also has a bolt hole 82 formed through its base, at its axis. The bolt hole 82 also extends through the wall of the head section 75 opposite the bearing bore 80.

All of the components of a leg and panel unit 10 have now been described and illustrated. In effect, then, all the components of the leg and panel unit 110 have also been described and illustrated, since they are identical. Now, the method of assembly of the leg and panel units 10 and 110 and, finally, the mating of those units to form the assembly 5, will be described.

A leg and panel unit 10 is assembled by seating three panel members 21, 22 and 23 on the leg members 31 and 32 and securely fastening them with bolts 21*a* and 21*c*, 22*a* and 22*c*, and 23*a* and 23*c*, and with nuts 21*b* and 21*d*, 22*b* and 22*d*, and 23*b* and 23*d*. The channels 68 and 69 in each of the panels 21, 22 and 23 are seated in corresponding elongated depressions 51, 52 and 53 in the leg members 31 and 32. Because the depth of each channel 68 and 69 is one-half the thickness of the panel member (except at the discontinuities 68*a* and 69*a*), and the depth of each depression 51, 52 and 53 is the same (except for discontinuities 51*a*, etc.), the panel members 21, 22 and 23 seat in interlocking relationship with the leg members 31 and 32 while, at the same time, their outer surfaces are substantially flush with the surfaces of the flanges 45 between those recesses. The discontinuities 68*a*, 68*b*, 68*c* and 69*a*, 69*b* and 69*c* in the channels 68 and 69 in panel member 21, for example, mate with corresponding discontinuous cut-outs 51*a* (see 51*a* in FIG. 6) molded into the depression 51. The panel members 22 and 23 seat in the same way. This interlocking relationship of panel members and leg members creates leg and panel units which can absorb great impact loads without breaking up.

With the panel members 21, 22 and 23 bolted in place on the leg members 31 and 32, the nuts 21*b* and 21*d*, 22*b* and 22*d*, and 23*b* and 23*d* protrude outwardly of the flanges 46, as do the threaded bolt ends to which they are attached. At the same time, the heads of each bolt 21*a* and 21*c*, 22*a* and 22*c*, and 23*a* and 23*c* are relatively low in profile so that they protrude only slightly. The implication of this construction in the context of the invention will shortly be discussed.

Next, another leg and panel unit is assembled of identical components, in this case the leg and panel unit 110. The two identical leg and panel units 10 and 110 are then placed in face-to-face relationship, so-to-speak, with their respective panel members 21–23 and 121–123 facing outwardly. The stub bearings 60 and 160 on the leg members 31 and 131 are introduced into the bearing bores 180 and 80 on the leg members 132 and 32, respectively, by moving the leg and panel units 18 and 110 traversely of each other. The ears 61 on the stub bearings 60 then lie within the confines of the corresponding bore lobes 81.

Figure 15:
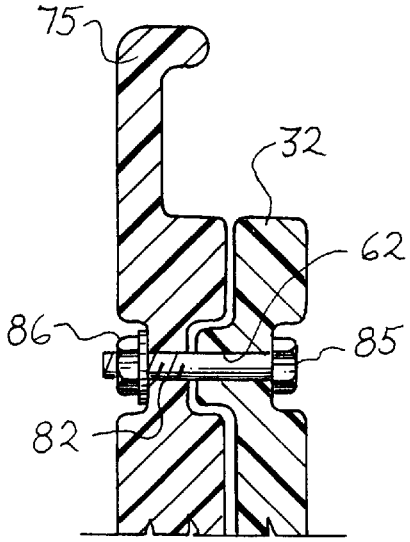
FIG. 15 is a vertical sectional view through the head sections of first and second leg members, as assembled.

At this point, referring to FIG. 15, a bolt 85 is passed through the aligned bolt holes 62 and 82 in the head sections 32 and 75 of each mated pair of leg members, i.e. leg members 31, 132 and 32, 131. A nut 86 is turned onto the threaded end of each nut 85. The panel units 10 and 110 are securely connected in this way to form the barricade assembly 5.

FIGS. 1 and 2 show the completed assembly 5 in its open position, ready for use. In this position, the ear 58 on the head section 32 of the leg member 31 has engaged and is stopped against the upper edge of the panel member 121 in the leg and panel unit 110. At the same time, the ear 158 on the head section 132 of the leg member 131 has engaged and is stopped against the upper edge of the panel member 21 in the leg and panel unit 10.

Figure 16A:
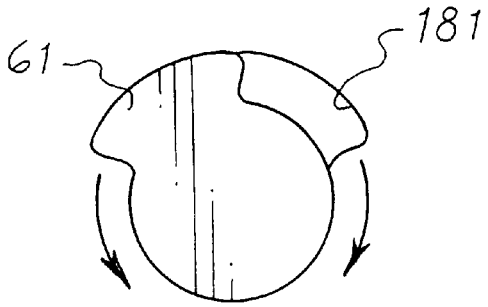
FIG. 16A is a diagrammatic view of the pivot bearing and locking cam relationship, open position.

At the same time, further spreading of the leg and panel units 10 and 110 is also stopped by the cams 61 and 161. These cams 61 and 161 reach the limit of their travel in corresponding lobes 81 and 181 of mating bearing bores 80, as is illustrated in FIG. 16A. Thus, integrity of the assembly 5 is insured by providing dual limit stops associated with each mating pair of leg members.

The construction of the leg members 31, 32 and 131, 132, and the manner in which they are connected to corresponding panel members produces, according to the invention, particularly high resistance to deformation under load. As a result, external weights in the form of sandbags, for example, do not cause the assembly 5 to sag over time.

Figure 17:
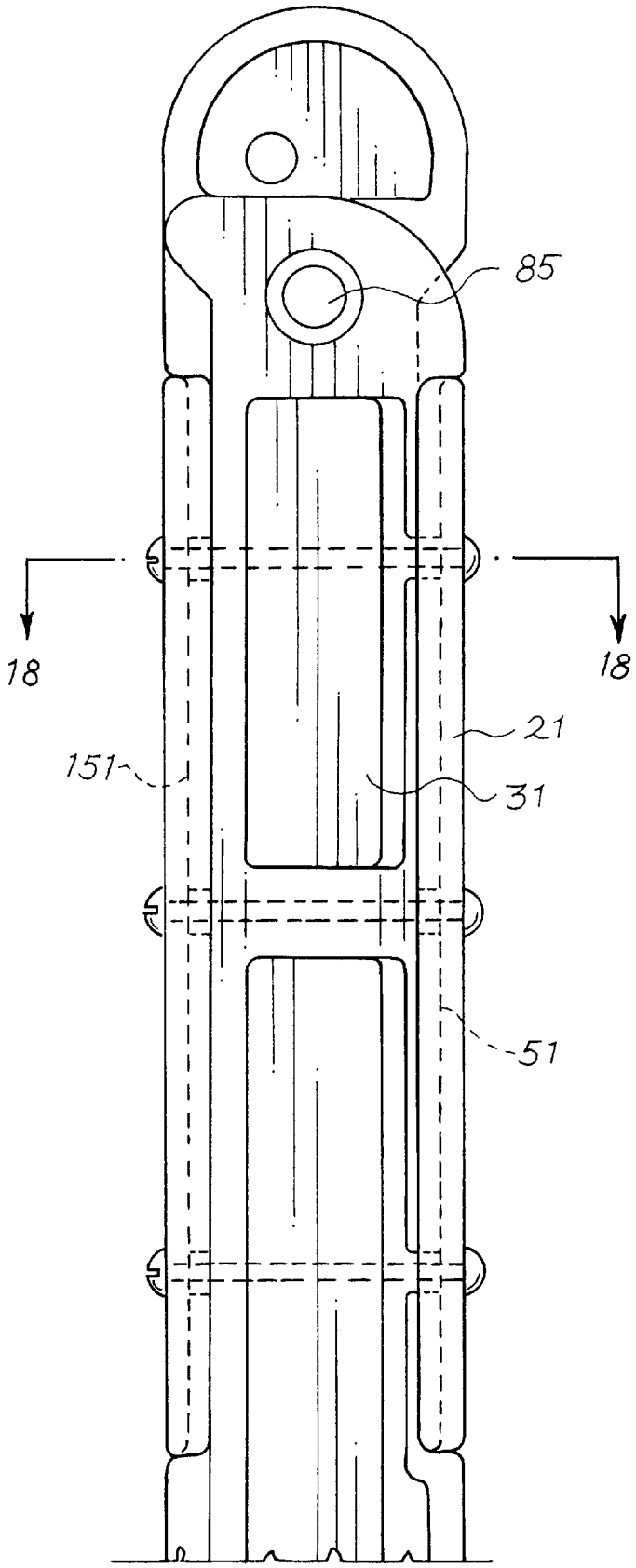
FIG. 17 is an enlarged side elevational view of the assembly of FIGS. 1 and 2, but in its closed relationship.
Figure 16B:
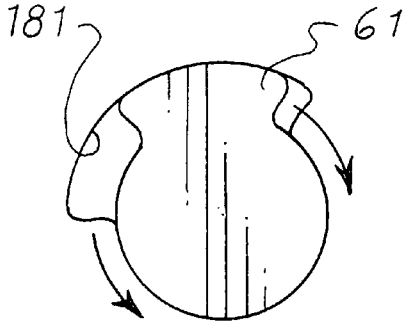
FIG. 16B is a view similar to FIG. 16A showing the closed position relationship.

When it is desired to collapse and store or ship the assembly 5, the leg and panel units are pivoted toward each other, about the co-axial axes of the bearings 60, 160 and bearing bores 80, 180 (which are also the axes of the bolts 85). Because these axes are offset from the centerlines of corresponding leg members by the thickness of the panel members 21–23 and 121–123, the leg and panel units 10 and 110 can collapse into the nested relationship seen in FIG. 17. In this configuration, the cams 61 and 161 are in the positions shown in FIG. 16B.

Figure 18:
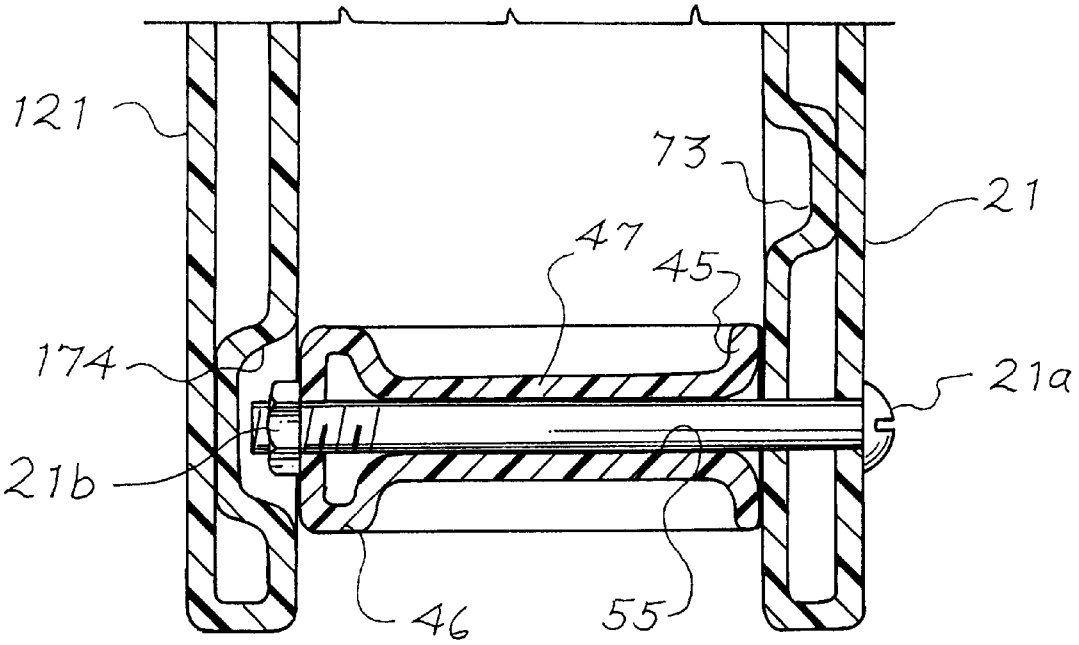
FIG. 18 is a sectional view taken along line 18—18 of FIG. 17, with parts removed.

The intimacy of the nested relationship is also enhanced by mating of the nuts 21*b* and 121*b*, 22*b* and 122*b*, and 23*b* and 123*b* with corresponding cup-shaped depressions 74 formed in the back of each panel member 21–23 and 121–123. This relationship is shown in FIG. 18, where it will be seen that when the leg and panel units 10 and 110 are collapsed against each other, corresponding nuts 21*b*, etc. (with associate bolt ends) are, in effect, housed within corresponding depressions 74.

The preferred embodiment of the barricade assembly 5 has been discussed in terms of a traffic barricade. However, it should be understood that the invention might also take the form of some other kind of barricade or sign support assembly, for example. Regardless of which, the structure is compact, highly resistant to impact load, able to easily support sand-bag weights without deforming and readily cannibalized for components.

We claim:

1. A barricade assembly comprising:

a) a first leg and panel unit and a second leg and panel unit, said leg and panel units being pivotally connected with each other;

b) at least one of said leg and panel units including two leg members and a panel member separately molded of plastic and rigidly interconnected;

c) each of said leg members including a foot section, a body section and a head section;

d) said body section of each said leg member being molded having a substantially I-beam shaped cross-section including an outer flange;

e) at least one longitudinally elongated depression formed in said body section of each leg member, said flange extending along a substantial portion of said depression in each body section;

f) said panel member having opposite ends and an inner face; and g) a channel formed in said inner face adjacent each of said ends;

h) said panel member being seated on each said leg member in a corresponding one of said elongated depressions;

i) each of said leg members being seated on said panel member in a corresponding one of said channels.

2. The barricade assembly of claim 1 further characterized in that:

a) each of said elongated depressions has a predetermined depth along a substantial portion of its length;

b) said predetermined depth of said depressions being less than the thickness of said panel member.

3. The barricade assembly of claim 2 further characterized in that:

a) said panel member has an outer face;

b) said outer face being substantially flush with said outer edges of said leg member body sections.

4. The barricade assembly of claim 2 further characterized in that:

a) each of said channels has a predetermined depth along a substantial portion of its length;

b) said predetermined depth of each depression is substantially equal to said predetermined depth of a corresponding channel.

5. The barricade assembly of claim 2 further characterized in that:

a) one of said channels is formed in said inner face of said panel member at a greater distance from the corresponding adjacent end of said panel member than the other of said channels is from the other adjacent end of said panel member.

6. The barricade assembly of claim 1 further characterized in that:

a) The depth of said depression in each of said outer flanges is less than the thickness of said flange.

7. The barricade assembly of claim 1 further characterized in that:

a) said channels formed in said inner face of said panel member are formed at different distances from corresponding opposite ends.

8. The barricade assembly of claim 7 further characterized in that:

a) said first and second leg and panel units are pivotally interconnected in an offset relationship;

b) the amount of offset corresponding to the difference in distance between said channels and corresponding ends.

* * * * *